United States Patent [19]

Bergvall

[11] Patent Number: 4,662,295

[45] Date of Patent: May 5, 1987

[54] SEAM INDICATING ARRANGEMENT IN A SEWING MACHINE

[75] Inventor: Bengt A. Bergvall, Huskvarna, Sweden

[73] Assignee: Husqvarna Aktiebolag, Husqvarna, Sweden

[21] Appl. No.: 846,037

[22] Filed: Mar. 31, 1986

[51] Int. Cl.[4] ..... D05B 3/02

[52] U.S. Cl. ..... 112/445

[58] Field of Search ..... 112/445, 453, 454, 456, 112/458, 121.11, 121.12

[56] References Cited

U.S. PATENT DOCUMENTS

| | | | |
|---|---|---|---|
| 4,446,520 | 5/1984 | Shigeta et al. | 112/445 X |
| 4,502,402 | 3/1985 | Kato | 112/445 |
| 4,512,271 | 4/1985 | Herdeg | 112/121.12 X |

*Primary Examiner*—Peter Nerbun

*Attorney, Agent, or Firm*—Alfred E. Miller

[57] ABSTRACT

A seam indicating arrangement in an electronic sewing machine displays all the seams that can be sewn. The seam illustrations are displayed on an electronic display where several groups of seam illustrations can become visible by means of electric signals. Thus, the arrangement shows the seam illustrate as well as a marker and is connected to a seam selecting arrangement by which the groups can be presented one by one and the marker moved between several illustrations.

9 Claims, 12 Drawing Figures

1b

1c

1d

2b

2c

2d

SEAM INDICATING ARRANGEMENT IN A SEWING MACHINE

The present invention relates to a seam indicator in an electronic sewing machine with several seams which can be sewn after an adjustment of a seam selecting means.

It is a problem in an electronic sewing machine with several seams to display all of the seams that can be sewn. The number of seams is so great that the illustrations of them together cover a great surface. Another problem is how to arrange a seam selection device, where one seam at a time can be selected. In the prior art a solution is known in which the seams are allotted a number of cassettes, whereby just a limited set of seams is shown simultaneously. In another case the seams are shown on a lid or the like where each seam has a number and the same is selected by setting the number on a numerical input arrangement on the machine.

The density of illustrations in an indicating arrangement is restricted by the fact that there must be a certain spacing between the illustrations. Without such a spacing the illustrations will run into each other and be difficult to assess. A solution to this problem is presented by the present invention.

The seam illustrations are provided on an electronic indicating arrangement according to this invention so that several groups of seam indications become visible one by one by means of electric signals. In such an arrangement the seam illustrations can abut each other whereby every second one, for instance, belongs to one group and the others to another group. By means of an operating member the operator can change showing the different groups. In an arrangement of this kind there must also be markers to show a selected seam. The markers can be spots which are made visible by electronic means, one for each seam illustration. Also devices making the selected seam illustrated deviate in brightness, preferably higher, can be markers. They are controlled by a seam selecting means so designated that when it is activated it brings about a movement of the marker to the next visible seam illustration in a given direction. The means used to achieve these properties is a multiplex driver which is an effective mode to decrease the number of driving steps in the indicating arrangement. If it has many segments on a common plate, the number of connections to the arrangement is decreased which may be of the type LCD (Liquid Crystal Display) or ELD (Electroluminescent-display). In these arrangements the wiring is provided on at least one of two parallel glass discs which serve as wire carriers as well as liquid enclosing surfaces. By a combination of a special wiring and multiplex driving the problem of indicating seams in groups and a moveable marker has been solved by the invention so that the desired number of seam illustrations for the sewing machine is more than well fulfilled.

Figure 6:
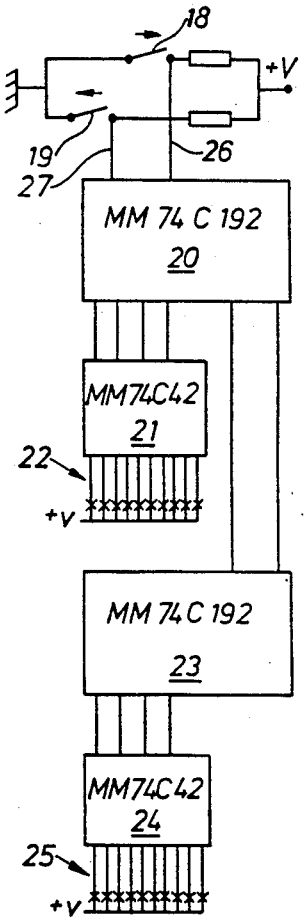

An embodiment of the arrangement according to the invention will be described in the following with reference to the accompanying drawings which show in FIG. 1*a–d* a simple indicating arrangement with seam illustrations and their performing, FIG. 2*a–d* diagrams showing wave forms, FIG. 3 a scheme of control signals, FIG. 4 a wiring diagram including modules, FIG. 5 a wiring diagram of change-over switches in the arrangement, FIG. 6 a variation of the arrangement.

Figure 1A:
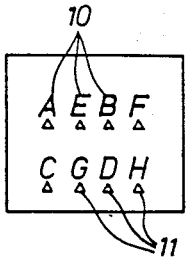
Figure 2A:
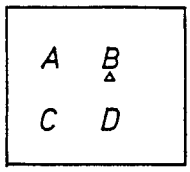
Figure 2A:
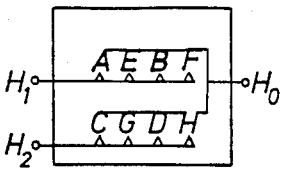
Figure 2A:
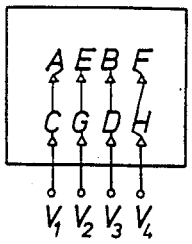
Figure 2A:
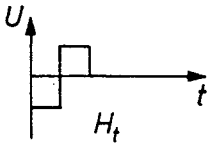

A display of the indicating arrangement is envisaged in FIG. 1*a* where eight seam illustrations in the form of the characters A–H and marker arrows are visible when all segments 10,11 in the arrangement are active. Usually, all segments are not active, so a typical illustration on the display can look like FIG. 1*b*. The display is constituted of a pair of glass discs on which the segments in the shape of transparent foils are applied and separated by a layer of liquid crystal (LCD). The foils form the said characters and arrows on the discs according to FIG. 1*a*. In order to apply voltage to the segments a wiring pattern is required on the discs. Such a pattern has horizontal ($H_0$, $H_1$, $H_2$) as well as vertical ($V_1$, $V_2$, $V_3$) wires and the composition of them on the disc with characters and arrows is shown in FIG. 1*c*, and on the disc with a corresponding foil in FIG. 1*d*.

The appearance of an illustration according to FIG. 1*b* takes place by supplying pulses in a multiplex system with a multiplier 2 on wires involved, i.e. the segments are divided into two phases which are supplied cyclically one by one. The time of a cycle is short, some 30 ms, so the eye will see a constant illustration. In one of the phases the illustrations of A, B, C, and D are included and in the second phase the markers. The supply to the multiplexarranged LCDs is effected by complex alternating waves, and in the following disclosure the waves applied to the conductors of one disc are denoted $H_{t(o)}$ and $H_{f(rom)}$ and to the other disc $V_{t(o)}$ and $V_{f(rom)}$, see FIGS. 2*a–d*.

Figure 3:
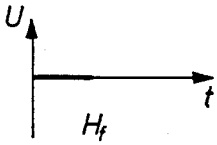
Figure 3:
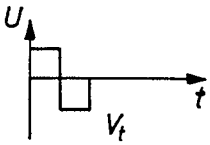
Figure 3:
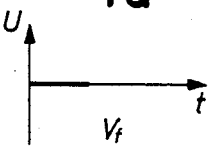
Figure 3:
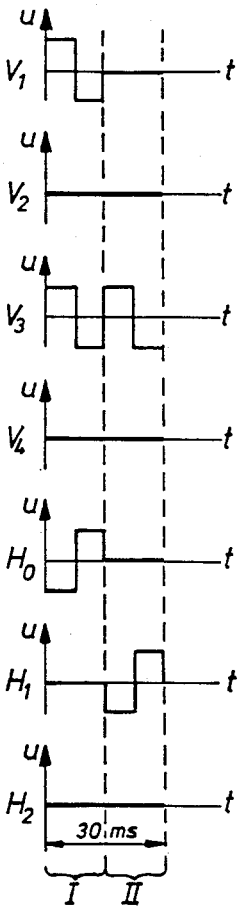

In FIG. 3 the four waves $H_t$, $H_f$, $V_t$ and $V_f$ of FIG. 2 are shown as they would be employed for producing the illustration in FIG. 1*b* by a wiring pattern according to FIGS. 1*c*, 1*d*. The waves $H_t$ and $H_f$ are applied to $H_0$, $H_1$ and $H_2$, respectively. The wave $V_t$ is applied to $V_1$, $V_3$, and the wave $V_f$ to $V_2$, $V_4$, respectively. Then the characters A, B, C, D appear. Moreover, $H_t$ is applied to $H_1$, and $H_f$ to $H_0$, $H_2$ and $V_t$ to $V_f$ to $V_1$, $V_2$, $V_4$. Then the arrow appears at B. FIG. 3 shows the curves during a cycle (30 ms) which is formed by two phases wherein, I=characters, II=marker. The procedure is repeated identically during all the following cycles.

Figure 4:
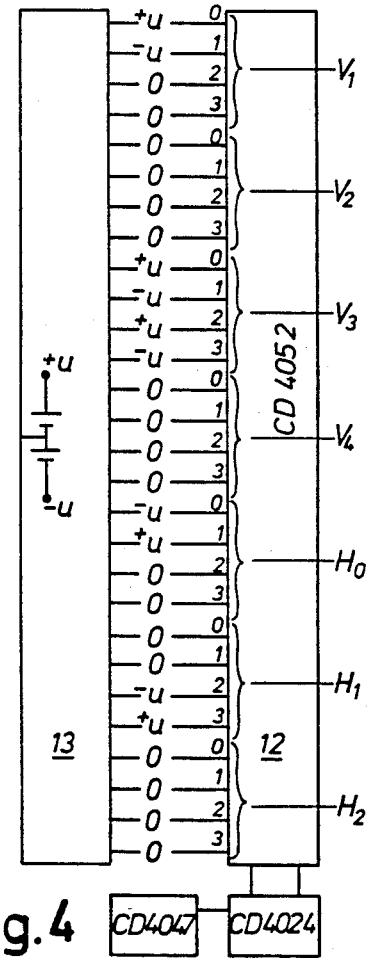
Figure 5:
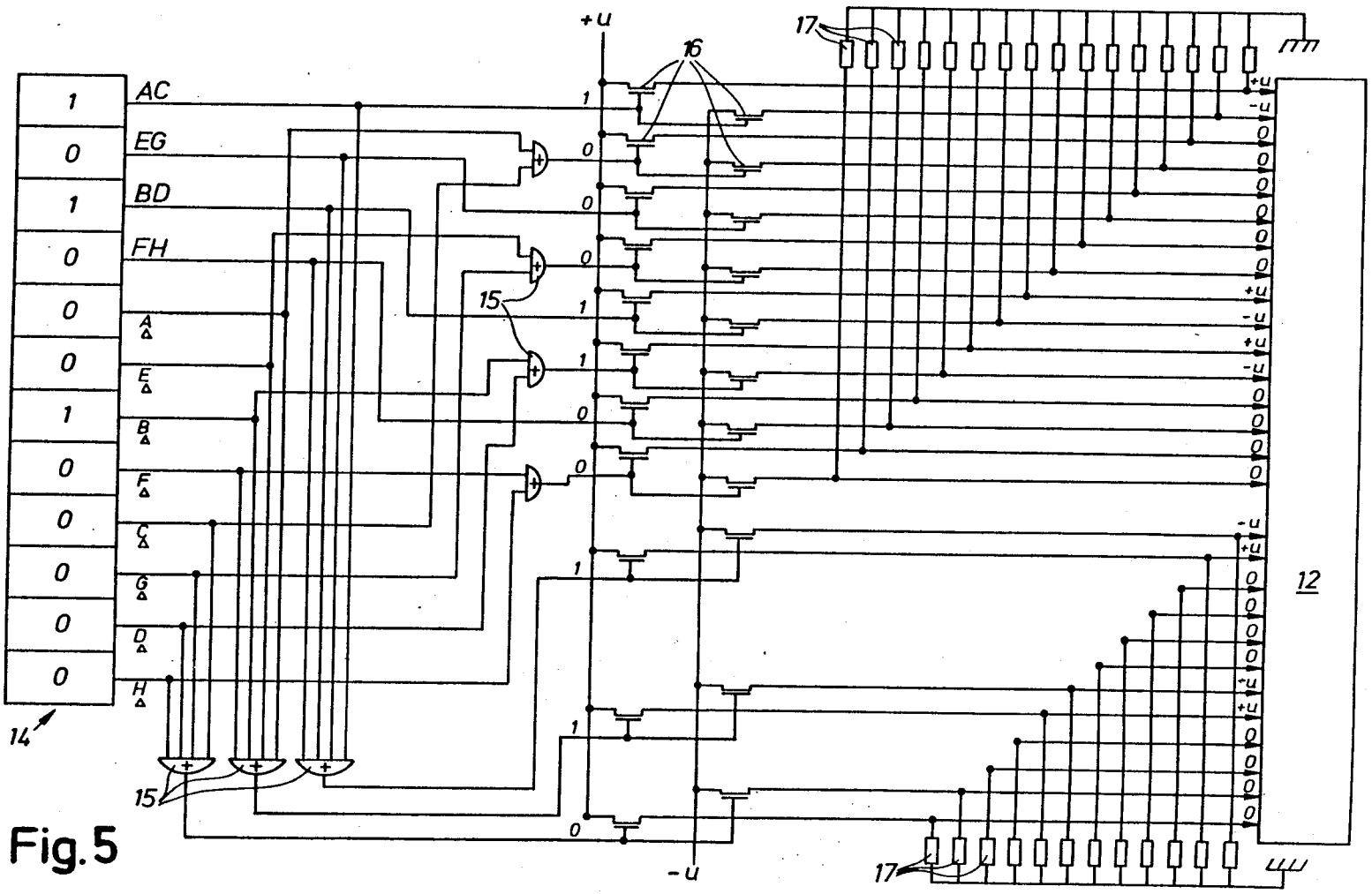

In practice, a so-called multiplexer 12 is used for producing the waves and constituted, as shown by the example in FIG. 4, of a CMOS-module number CD 4052. A counter CD 4024 and an oscillator CD 4047 are connected to the multiplexer. The oscillator produces a control pulse at every 7,5 ms to the counter which prepares and supplies to the multiplexer a number series 0, 1, 2, 3, 0, 1, 2 etc. cyclically with 7,5 ms between the units. The multiplexer is divided into sections for the waves $V_1$, $V_2$, $V_3$ etc and every section has four inputs 0, 1, 2, 3, some of which having constant voltages +U and −U, respectively. When the counter addresses on inlets 0 in each section the voltage U occasionally connected on these inlets passes to the respective outlet $V_1$, $V_2$, $V_3$ etc. By stepping on to 1 the voltage occasionally connected to inlets 1 passes to the outlets. A cycle (30 ms) thus includes addressing all inlets 0, 1, 2, 3, one by one. Then the counter repeats the number series during the following cycles, whereby the waves thus shown in FIG. 3 are produced in an infinite succession. The voltages +U and −U can by means of change-over switches 13 be moved to other inlets than the ones shown. Hereby other waves arise resulting in the display of another illustration than the one shown in FIG.

1*b*. By change-over switching it is thus possible to indicate all the eight characters A–H by the marker. What the wiring diagram of such change-over switches can look like is shown in FIG. 5. The example shows producing of +U and −U on the respective outlets according to FIG. 4. A twelve-bit memory 14 has been programmed in columns and the one giving the illustrations in FIG. 1*b* is shown. Outlets having common inlets to a switch-module 16 are collected on gates 15 and the voltages +U and −U are distributed with respect to the inlets so that 1 on the inlet means closing of the respective switch and 0 means breaking. A set of resistors 17 on the outlets to ground stabilizing the voltages which then are passed directly to the multiplexer (FIG. 4).

FIG. 1*b* shows one of the illustrations the arrangement can display. By addressing the waves to other wires the illustration can thus be varied. The arrangement is a simple example of showing a few seams and a marker on a display; the number can, of course, be multiplied by means of a corresponding number of segments and a wiring pattern belonging thereto. Possibly can, for instance, 100 seams be illutrated on the display distributed as 10×10. Analogously to the foregoing example the number of supply wires will be $H_0$, $H_1$, $H_2$, . . . $H_{10}+V_1$, $V_2$ . . . $V_{10}=21$. As a further development of the system more phases can be added and thus further segments be supplied, e.g. for showing stitch length and bight. Then the multiplex multiplier increases with 1 for every further phase.

In certain types of displays it is possible to displace the whole illustration stepwise in a horizontal or vertical direction. By such advanced indicating arrangements it is possible to display another group of seam illustrations constituting the previously shown group displaced a step horizontally and presenting further seam illustrations at one side of the display. A corresponding number of seam illustrations vanishes simultaneously at the opposite side of the display. Such a feeding of further illustrations is generally called "scrolling" and may be achieved by a network of modules according to FIG. 6.

Two manually operated switches 18,19 are connected to a decade counter 20 for a marker with the module number MM 74 C 192 which on receipt of a signal from the switch 18 counts up a step and on receipt of a signal from the switch 19 counts down a step. The switches are provided with arrows so that the operator sees in what direction the marker will move when the switch is actuated. The counter has a connection with a decoder 21 with the number MM 74 C 42 with ten outlets 22 which supply marker lamps or the like, and with a decade counter 23 for the seam illustrations, which counter is also connected to a decoder 24. The outlets 25 of the decoder apply voltage to a segment of illustration or the like, which shows, e.g., illustrations with the number 1–10. When the counter 20 has stepped from 1–10 and thus moved the marker across the whole display, another actuation of the switch 18 has the effect that a signal is output on a connection wire 26 to the counter 23 which then counts up so that the illustrations with the numbers 2–11 become visible. An actuation of the switch 19 then gives a signal on a connecting wire 27 which makes the counter 23 count down and restore the illustrations number 1–10. Thus, the switches effect counting both up and down on both sides of 10 with a presentation of further seam illustrations as far as the illustration series extends.

I claim:

1. In a seam indicating arrangement for an electronic sewing machine comprising a pair of parallel discs with an intermediate layer of liquid crystal, the two side surfaces of the discs facing each other having segments of a transparent foil and wiring patterns with wires to every separate segment, whereby when voltages are applied between the two segments defining a portion of an illustration the layer is actuated to make the respective portion of the illustration visible, the improvement comprising a multiplex voltage distributor connected to apply voltages to the wiring patterns to thereby apply voltages cyclically to the segments during at least two time phases, said distributor energizing in a first time phase the segments of one group of surface portions of a plurality of illustrations defining a plurality of seams, and energizing in another time phase the segments of a surface portion distinctly marking an illustration corresponding to a determined seam.

2. A seam indicating arrangement according to claim 1, comprising a seam illustration change-over switch coupled to the distributor for selectively applying voltages to one of at leaast two groups of the seam illustrations.

3. A seam indicating arrangement according to claim 2, comprising two manually operated switches connected to a counter and a decoder coupled to the change-over switch whereby repeated actuation of one of the two switches causes the seam illustrations to move in one direction and actuation of the other switch causes movement thereof in the other direction.

4. A seam indicating arrangement according to claim 3, wherein the counter also is connected to another counter and a decoder which are connected to the same illustration change-over switches and are responsive to the occurrence of an end position of the marker to effect the up or down counting in a numbering of a seam illustration group and therewith energize another group of seam illustrations of the arrangement.

5. A seam displaying arrangement for an electronic sewing machine comprising a display device having a plurality of display segments, a plurality of conductors selectively connected to said display elements, and supply means coupled to said conductors for selectively applying voltages thereto to thereby selectively energize said display elements, said supply means comprising multiplexing means having first means enabling the energizing of display elements corresponding to a plurality of different seams and a second means enabling modification of the display device to energize at least one selective display element to distinctively indicate a selected seam element, said first and second means being time multiplexed.

6. The seam displaying arrangement of claim 5 wherein said display device has display segments corresponding to marker elements, and said second means comprises means for selectively energizing said display segments corresponding to marking elements.

7. The seam displaying arrangement of claim 5 wherein said second means comprises means for varying the intensity of display elements corresponding to a selected seam element.

8. The seam displaying arrangement of claim 5 wherein said display device is an LCD.

9. The seam displaying arrangement of claim 5 further comprising a change-over switch connected to said multiplexing means enabling the selective energization of groups of display segments corresponding to different groups of seam elements.

* * * * *